United States Patent [19]

Harmon

[11] Patent Number: 4,754,921

[45] Date of Patent: Jul. 5, 1988

[54] CUSHIONED RAILROAD TRUCK ROADWAY CROSSING MODULE

[75] Inventor: Paul G. Harmon, Portland, Oreg.

[73] Assignee: Utility Vault Co., Inc., Auburn, Wash.

[21] Appl. No.: 946,204

[22] Filed: Dec. 24, 1986

[51] Int. Cl.[4] ..... E01B 2/00

[52] U.S. Cl. ..... 238/8; 238/265; 238/283; 238/315

[58] Field of Search ..... 238/5, 7–8, 238/264, 265, 278, 299, 310, 315, 321, 378, 283

[56] References Cited

U.S. PATENT DOCUMENTS

| | | | |
|---|---|---|---|
| 1,346,312 | 7/1920 | Furrow | 238/4 |
| 1,680,131 | 8/1928 | Corl | 238/299 |
| 3,544,006 | 12/1970 | Pennino | 238/283 |
| 3,612,394 | 10/1971 | Gagnon | 238/8 |
| 3,888,414 | 6/1975 | Duchemin | 238/283 |
| 3,892,356 | 7/1975 | Harmon | 238/8 |
| 4,047,663 | 9/1977 | Reynolds et al. | 238/283 X |
| 4,208,011 | 6/1980 | Dahlhaus et al. | 238/283 X |
| 4,232,823 | 11/1980 | Eggermann | 238/7 |
| 4,372,488 | 2/1983 | Schouthaler et al. | 238/8 |

*Primary Examiner*—Sherman D. Basinger
*Attorney, Agent, or Firm*—Eugene D. Farley

[57] ABSTRACT

A cushioned railroad track roadway crossing module comprises a base having a central raised section and a pair of opposite depressed side sections. Releasable rail fixation members for releasably fixing a pair of rails to the base in substantially parallel relation to each other are mounted one on each side of the base, substantially at the boundary between the central and side base sections.

13 Claims, 2 Drawing Sheets

CUSHIONED RAILROAD TRUCK ROADWAY CROSSING MODULE

BACKGROUND AND GENERAL STATEMENT OF THE INVENTION

This invention relates to railroad crossing rail bed units of the type employed in constructing railroad crossings across highways and private roads.

As is well known, railroad grade crossings are subjected to heavy stresses caused by the cyclic compressing and resurgence of the crossing components with the passage of each locomotive and railroad car traversing the crossing. This causes loosening of whatever fixation means is employed to fix the rails in place. It also causes spalling and breaking away of the concrete and asphalt paving materials associated with the crossing. If the crossing structure includes wooden ties, the ties are squeezed between the tie plates and ballast with resultant deterioration and fragmentation. Still further, the repeated impacts cause the ties to subside into the underlying ballast so that they no longer support the rails properly.

These factors make necessary periodic reconstruction and repair of the crossing. During such reconstruction and repair, the crossing surface must be removed and salvaged, if possible; the ties must be renewed and retamped to their former elevation; and the surface must be restored, all at considerable expense. After a short time, the cycle repeats itself.

In my former patents, Harmon U.S. Pat. No. 3,317,137 and Harmon U.S. Pat. No. 3,892,356, modular railroad grade crossings are described which in large measure overcome the foregoing problems. However, there is need for a crossing having a cushioned action which in particular compensates for the above noted cyclic compression and resurgence of the crossing structure which is so damaging to the crossing components. It is the primary purpose of the present invention to provide such a cushioned crossing.

Other objects of the present invention are the provision of a cushioned railroad grade crossing which eliminates the use of wood ties; which is easily adapted to various track forms and sizes; which is anchored to the surrounding pavement; which has provision for the mounting of signal-operating electric circuits; and which has provision for introducing pressurized grout beneath the crossing if major crossing subsidence should occur.

Further important objects of the present invention are the provision of a cushioned, modular grade crossing which is of relatively low initial cost; which conforms to the highway geometry; which is smooth and of neat appearance; and remains in this condition during a long service life, with minimum maintenance.

The foregoing and other objects of the invention are accomplished by the provision of a modular railroad grade crossing which in essence comprises a base, preferably formed of cast concrete, with an elevated central section having a substantially flat upper surface at roadway level and a pair of opposite, depressed side sections having upper surfaces at substantially rail base level. On each side of the base, at the boundaries between the central and side sections, there are releasable rail-fixation means for releasably fixing a pair of rails to the base in substantially parallel relation to each other.

The fixation means comprise a plurality of rail fixation members arranged in rows, one row on each side of the base.

Each fixation member comprises broadly a connector underlying the rail, transversely thereof. The connector mounts a rail keeper on one of its ends and a releasable rail clamp on the other of its ends. A cushioning means such as a resiliently compressible pad is inserted between the keeper and the rail, and between the clamp and the rail. A running strip of compressible material underlies the rail. A cushioned rail mounting thus is provided which absorbs the recurring shocks of compression and resurgence accompanying each train passage. At the same time, the rails are efficiently fixated in the crossing so that the damage to the crossing components is kept at a minimum.

THE DRAWINGS

Figure 1:
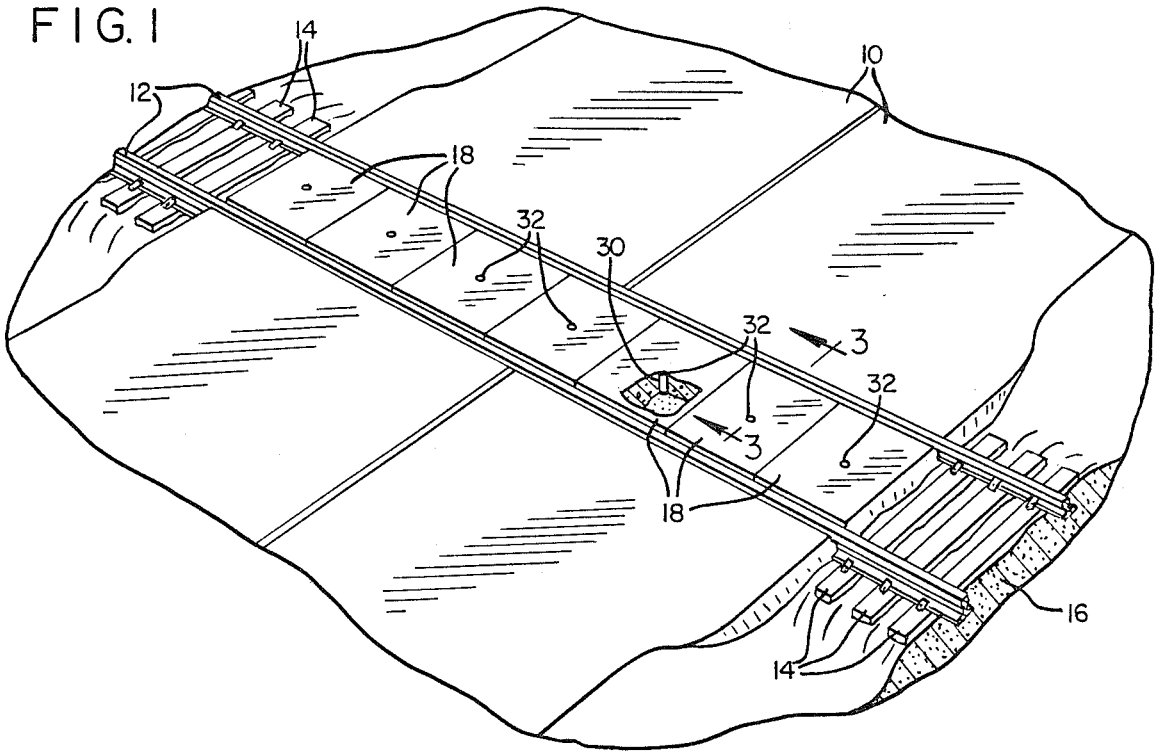
FIG. 1 is a top perspective view of a railroad crossing made up of a plurality of the cushioned crossing modules of the invention.
Figure 3:
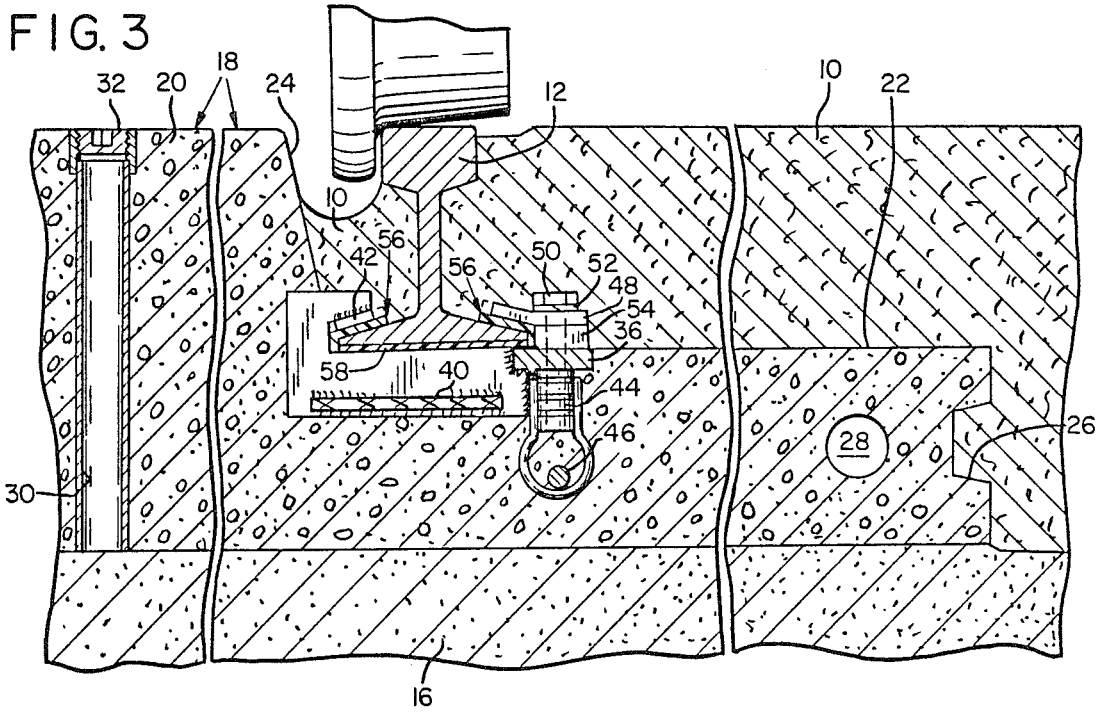

FIG 3. is an enlarged, foreshortened, sectional view taken along the line 3—3 of FIG. 1.

Figure 5:
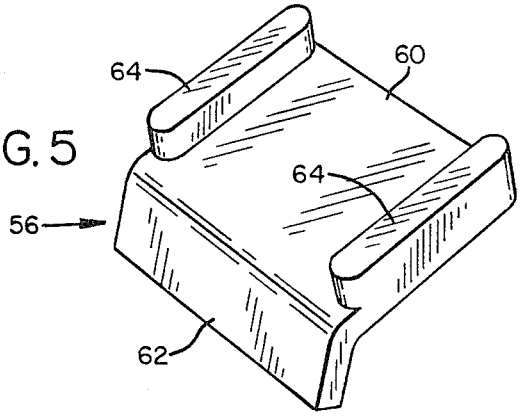
Figure 4:
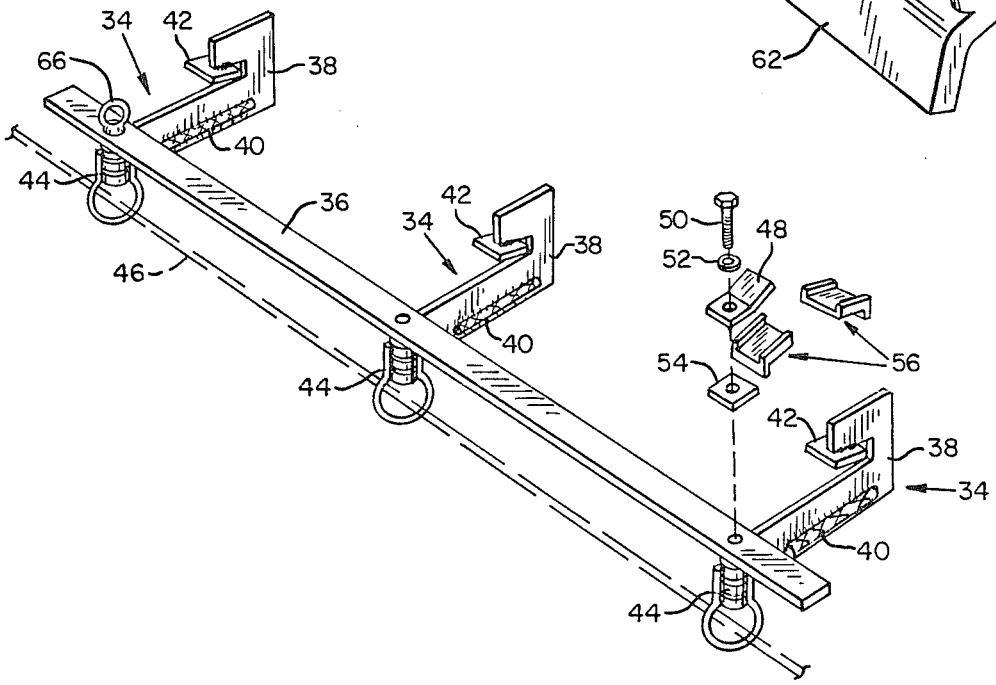

FIG. 4 is a top perspective exploded view of one of the fixating assemblies employed in the crossing module, and FIG. 5 is an enlarged top perspective view of one of the cushioning elements employed in the rail-fixating assembly.

DETAILED DESCRIPTION OF A SPECIFIC EMBODIMENT OF THE INVENTION

The application of the cushioned railroad crossing module of my invention is illustrated in FIG. 1.

As illustrated, the module is adapted for the construction of a railroad crossing across either a highway or a private roadway 10. The construction is of particular interest on the grounds, or in the buildings, of industrial plants where it is necessary to provide a railroad crossing having a smooth, trouble-free, quiet crossing surface to be traversed by various types of load-carrying vehicles including lift trucks, dollies, tractors and trailers, etc.

The railway itself is conventional, being comprised of rails 12 and ties 14 supported on tamped and screeded ballast 16 in the usual way.

The crossing is made of a plurality of modular units indicated generally at 18. These may be substantially identical to each other. They are placed contiguously side-by-side to provide a railroad crossing of any desired length.

Figure 2:
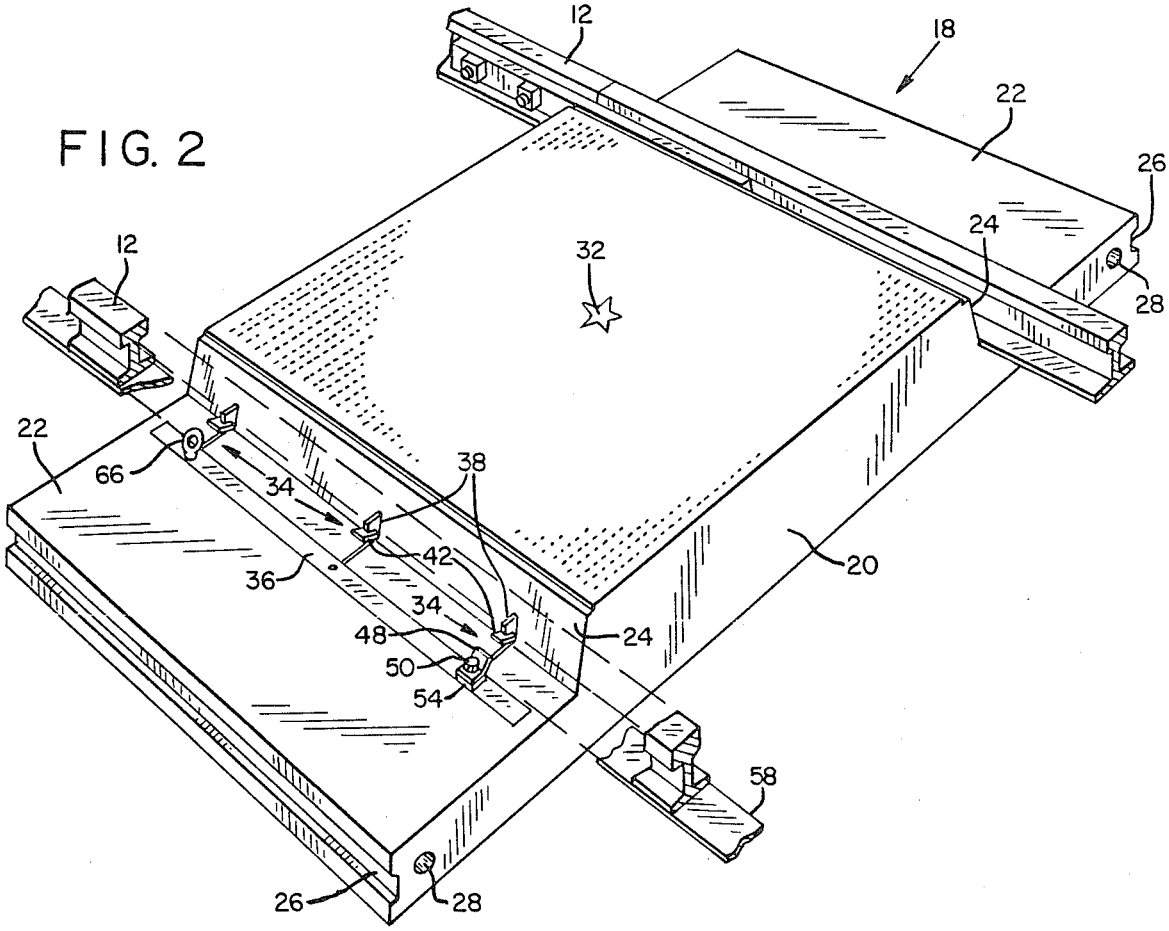
FIG. 2 is an enlarged top perspective view of a single crossing module illustrating the manner of mounting the rails thereon.

The construction of each module is shown particularly in FIGS. 2 and 3.

Each module includes a base of suitable structural material, preferably cast concrete. The base is in three sections: an elevated central section 20 having a substantially flat upper surface at substantially roadway level, and a pair of opposite, depressed side sections 22 having upper surfaces at substantially rail base level. The transition areas or boundaries between the raised center section and the depressed side sections provide shoulders 24.

The upper surface of center section 20 is flat and designed to be substantially coplanar with the surface of roadway 10. To improve surface traction, it preferably has a molded-in deck plate finish and accordingly provides an improvement over plastic rubber deck surfaces which, when wet, increase skidding.

Depressed side sections 22 are arranged generally parallel to each other and underly the asphalt or concrete paving of roadway 10, to which they are keyed by means of molded-in, longitudinally extending keyways 26 extending along their longitudinal side edges.

Side sections 22 also may be used to advantage to mount the electric cables or other conductors which are used for signalizing the railway. To this end, they are provided with molded in openings or conduits 28. These are arranged so that they are perfectly aligned with each other from module to module and are electrically insulated from the rails.

The bottoms of the modules are formed with broomed-in striations, not illustrated. These inhibit lateral movement from thrust on curves and provide added stabilization to the crossing assembly.

Provision also is made for introducing pressurized concrete grout into the area beneath the module in the event of major subsidence of the underlying ballast during the service life of the crossing. To this end there are formed transversely through the center sections of the base passageways which receive conduits 30 with associated threaded plugs 32. The latter are at roadway level and afford access for connecting conduit 30 to a pressurized grout supply. Accordingly, at any time during the service life of the crossing, grout under pressure may be introduced into the area beneath the crossing module for filling underlying voids and even for jacking up a subsident module to return it to its original level.

Rail fixation assemblies are provided for releasably fixing a pair of rails on the base in substantially parallel relation to each other. The fixation assembly is illustrated particularly in FIG. 4. Its application is illustrated particularly in FIGS. 2 and 3.

As illustrated, the fixation assembly comprises a plurality of rail fixation members 34 arranged in rows, one row on each side of the base substantially at the boundaries between the central and side sections thereof. In the illustrated form of the invention there are three rail fixation members 34 in each assembly, tied together by means of a tie bar 36 to which they are welded to form an integral unit. The assembly is designed to be embedded in the concrete base and fixedly to mount the rails to the base in the manner shown in FIG. 3.

As is apparent from that Figure, each rail fixation member basically comprises a connector underlying the rail, transversely thereof, a rail keeper or retainer on one end of the connector positioned for receiving and releasably retaining one side of the rail, and releasable clamp means on the other end of the connector for receiving and releasably clamping the other side of the rail.

In the illustrated form of the invention, the connector and rail keeper are integrated in a vertically disposed, J-shaped plate 38 embedded in the concrete, where it is anchored in position by means of flanges (re-bar sections) 40 welded to its opposite side faces.

The notch of the J-shaped member receives the rail, which is maintained in position by means of a bearing piece 42 welded to the inner face of the outer leg of the J-shaped keeper.

The rail clamp means provided on the other side of the rail comprises anchor means, welded or otherwise affixed to the end of the connector opposite the rail keeper, with an associated rail clamping mechanism.

As shown in FIGS. 3 and 4, the anchor means comprises a conventional, internally-threaded, externally-flanged ferrule loop anchor 44. This member of the assembly securely anchors the unit in the concrete base by means of its external flanges which are embedded in the concrete and also by means of the ferrule loops which receive re-bar 46, also embedded in the concrete.

The ferrule loop anchors are welded to the ends of J-plates 38 below tie bar 36, which also is welded to the ends of the J-plates. A clamp plate 48 is mounted on anchor 44 by means of rotary interengaging means, specifically by bolt 50 with washer 52. A shoulder block 54, which also serves as a filler block, shoulders the clamp against the rail base, adding further stability to the structure.

As indicated above, it is a primary feature of the present invention that the rail fixation assembly is a cushioned assembly which protects the structure from the devastating effects of cyclic rail depression and resurgence. This result is achieved by the inclusion in the assembly of rail resurgence pads 56 associated with both J-plate 38 and clamp plate 48 cooperating with a compression strip 58, underlying rails 12.

The construction of pads 56 is illustrated in FIG. 5; their manner of application, in FIG. 3.

Each resurgence pad comprises a block of resiliently compressible material such as polyurethane. It is formed with a base 60 with downturned lip 62. A pair of upstanding, spaced shoulders 64 are integral with the base of the block.

The pads 56 are designed to bear against the upper surface of the rail base, one on each side. With the downwardly turned lip 62 fitting the downwardly inclined contour of the rail base. Bearing plate 42 of the rail keeper seats on the upper surface of the resurgence pad base 60, between the shoulders 64 holding the pad securely in operative position.

Similarly, clamp plate 48 seats on the upper surface of the base of a companion resurgence pad, between shoulders 64 thereby securely mounting the other side of the rail base. Shoulder block 54 cooperates by insuring that the rail base will be fully inserted in, and maintained in, the keeper unit of the assembly.

The cooperating compressible strip 58 underlies rail 12 in the manner illustrated in FIG. 2. It is maintained in position by the great weight of the superimposed rail.

Various resiliently compressible materials may be used for the purpose, provided they are sufficiently tough and durable to withstand the abrasive forces imposed upon them. Ultra-high-molecular weight polyethylene-propylene has been found to be well suited.

An I-bolt 66 welded to tie bar 36 completes the assembly. It is used in assembly placement with a 4-way sling or other suitable hoisting apparatus.

The releasable clamping assembly is assembled in the manner illustrated in FIG. 4. When assembled, with the rail in place, the inner keeper or retainer 38 embedded in the concrete provides positive fixation of the rail while permitting adjustment to wide gauge rails by increasing the width of the rail flangeway to prevent chafing or spalling. This result is reinforced by the action of clamp plate 48, which further fixes the rail in position while permitting adjustment for rail gauge. Resurgence pads 56 and compression strip 58 protect the assembled unit from damage caused by rail compression and resurgence during use. There thus is provided a cushioned railroad crossing assembly characterized by stability, efficient operation, and exceptionally long life.

Having thus described in detail a preferred embodiment of the present invention, it will be apparent to those skilled in the art that various physical changes could be made without altering the inventive concepts and principles embodied. The present embodiment is therefore to be considered in all respects as illustrative and not restrictive, the scope of the invention being indicated by the appended claims. All changes which come within the meaning and range of equivalency of the claims are therefore to be embraced therein.

I claim:

1. A cushioned railroad track roadway crossing module comprising:

(a) a base formed with an elevated central section having a substantially flat upper surface at substantially roadway level and a pair of opposite, depressed side sections having upper surfaces at substantially rail-base level, (b) on each side of the base, substantially at the boundaries between the central and side sections, a plurality of longitudinally spaced, releasable rail-fixation members arranged in a row for releasably fixing a pair of rails to the base in substantially parallel relation to each other, and (c) a longitudinally extending tie bar fastened to the fixation members of each row for maintaining them in predetermined spaced relation to each other, (d) the base being made of cast concrete, each fixation member comprising a connector underlying the rail base, transversely thereof, a rail keeper on one end of the connector positioned for receiving and releasably retaining one side of the rail base, and releasable clamp means on the other end of the connector for receiving and releasably clamping the other side of the rail base, the connector and keeper comprising an integral, vertically disposed J-shaped plate embedded in the concrete.

2. The module of claim 1 including a block of resiliently compressible material on the keeper arranged as a pad for bearing against the upper surface of the rail base.

3. The module of claim 2 wherein the block of resiliently compressible material is shaped with spaced shoulders on its upper surface and a downturned lip on its outer margin to conform to the contour of the rail base, the keeper including a bearing piece seated between the shoulders of the pad.

4. The module of claim 1 wherein the clamp means comprises an internally threaded ferrule loop anchor secured to the J-shaped plate and embedded in the concrete, a clamp plate bearing on the upper surface of the rail base, and a bolt threaded into the ferrule loop anchor and mounting the clamp plate on the ferrule loop anchor.

5. The module of claim 4 including a pad of resiliently compressible material interposed between the upper surface of the rail base and the clamp plate.

6. The module of claim 5 wherein the pad comprises a block of resiliently compressible material shaped with spaced shoulders on its upper surface and a downturned lip on its outer margin to conform to the contour of the rail base, the pad being positioned beneath the clamp plate and the shoulders being spaced to receive the clamp plate in bearing engagement.

7. The module of claim 6 including a shoulder block interposed between the ferrule loop anchor and the pad and bearing against the downturned lip of the pad.

8. The module of claim 1 including a running strip of resiliently compressible material interposed between each row of rail-fixation members and the associated rail base.

9. The module of claim 8 wherein the running strip comprises ultra high molecular weight polyethylene-propylene.

10. A cushioned railroad track roadway crossing module comprising:

(a) a base of cast concrete formed with an elevated central section having a substantially flat upper surface at substantially roadway level and a pair of opposite, depressed side sections having upper surfaces at substantially rail-base level, and (b) on each side of the base, substantially at the boundaries between the central and side sections, a plurality of longitudinally spaced, releasable rail-fixation members arranged in a row for releasably fixing a pair of rails to the base in substantially parallel relation to each other, each fixation member comprising (1) a connector underlying the rail base, transversely thereof, (2) a rail keeper on one end of the connector positioned for receiving and releasably retaining one side of the rail base, (3) releasable clamp means on the other end of the connector for receiving and releasably clamping the other side of the rail base, (4) the connector and keeper comprising an integral, vertically disposed J-shaped plate embedded in the concrete, (5) pad means on the keeper arranged for bearing against the upper surface of the rail base, the pad means comprising a block of resiliently compressible material shaped with spaced shoulders on its upper surface and a downturned lip on its outer margin to conform to the contour of the rail base, and (6) a bearing piece attached to the keeper and seated between the shoulders of the pad.

11. A cushioned railroad track roadway crossing module comprising:

(a) a base of cast concrete formed with an elevated central section having a substantially flat upper surface at substantially roadway level and a pair of opposite depressed side sections having upper surfaces at substantially rail-base level, and (b) on each side of the base, substantially at the boundaries between the central and side sections, a plurality of longitudinally spaced, releasable rail-fixation members arranged in a row for releasably fixing a pair of rails to the base is substantially parallel relation to each other, each fixation member comprising (1) a connector underlying the rail base, transversely thereof, (2) a rail keeper on one end of the connector positioned for receiving and releasably retaining one side of the rail base, (3) releasable clamp means on the other end of the connector for receiving and releasably clamping the other side of the rail base, the clamp means comprising an internally threaded ferrule loop anchor embedded in the concrete, a clamp plate bearing on the upper surface of the rail base, and a bolt threaded into the ferrule loop anchor and mounting the clamp plate on the ferrule loop anchor, and (4) a pad of resiliently compressible material interposed between the ferrule loop anchor and the clamp plate, the pad comprising a block of resiliently compressible material shaped with spaced shoulders on its upper surface and a downturned lip on its outer margin to conform to the contour of the rail base, (5) the pad being positioned beneath the clamp plate and the shoulders being spaced to receive the camp plate in bearing engagement.

12. The module of claim 11 including a shoulder block interposed between the ferrule loop anchor and the pad and bearing against the downturned lip of the pad.

13. A cushioned railroad track roadway crossing module comprising:

(a) a base of cast concrete formed with an elevated central section having a substantially flat upper surface at substantially raodway level and a pair of opposite, depressed side sections having upper surfaces at substantially rail-base level, and (b) on each side of the base, substantially at the boundaries between the central and side sections, a plurality of longitudinally spaced, releasable rail-fixation members arranged in a row for releasably fixing a pair of rails to the base in substantially parallel relation to each other, each fixation member comprising (1) a connector underlying the rail base, transversely thereof, (2) a rail keeper on one end of the connector positioned for receiving and releasably retaining one side of the rail base, (3) releasable clamp means on the other end of the connector for receiving and releasably clamping the other side of the rail base, (4) the connector and keeper comprising an integral, vertically disposed J-shaped plate embedded in the concrete, (5) pad means on the keeper arranged for bearing against the upper surface of the rail base, the pad means comprising a block of resiliently compressible material shaped with spaced shoulders on its upper surface and a downturned lip on its outer margin to conform to the contour of the rail base, (6) the keeper including a bearing piece seated between the shoulders of the pad, (7) the clamp means comprising an internally threaded ferrule loop anchor embedded in the concrete, a clamp plate bearing on the upper surface of the rail base, and a bolt threaded into the ferrule loop anchor and mounting the clamp plate on the ferrule loop anchor, (8) a pad of resiliently compressible material interposed between the ferrule loop anchor and the clamp plate, the pad comprising a block of resiliently compressible material shaped with spaced shoulders on its upper surface and a downturned lip on its outer margin to conform to the contour of the rail base, (9) the pad being positioned beneath the clamp plate and the shoulders being spaced to receive the clamp plate in bearing engagement,

(10) a shoulder block interposed between the ferrule loop anchor and the pad and bearing against the downturned lip of the pad, and

(11) a longitudinally extending tie bar fastened to the fixation members of each row for maintaining them in predetermined spaced relation to each other, and (c) a running strip of resiliently compressible material interposed between each row of rail-fixation members and the associated rail base.

* * * * *

UNITED STATES PATENT AND TRADEMARK OFFICE

CERTIFICATE OF CORRECTION

PATENT NO. : 4,754,921

DATED : July 5, 1988

INVENTOR(S) : PAUL G. HARMON

It is certified that error appears in the above-identified patent and that said Letters Patent are hereby corrected as shown below:

ON THE TITLE PAGE AND COLUMN 1, TITLE OF INVENTION,

"Cushioned Railroad Truck Roadway Crossing Module" to read

-- Cushioned Railroad Track Roadway Crossing Module --.

Signed and Sealed this

Sixth Day of December, 1988

*Attest:*

DONALD J. QUIGG

*Attesting Officer*

*Commissioner of Patents and Trademarks*